US009957856B2

(12) United States Patent
Beier et al.

(10) Patent No.: US 9,957,856 B2
(45) Date of Patent: May 1, 2018

(54) HYDRAULIC VALVE DRIVE OF AN INTERNAL COMBUSTION ENGINE

(71) Applicant: Schaeffler Technologies AG & Co. KG, Herzogenaurach (DE)

(72) Inventors: Steve Beier, Schwanstetten (DE); Arno Bachstadt, Furth (DE); Hendrik Thomann, Erlangen (DE)

(73) Assignee: Schaffer Technologies AG & Co. KG, Herzogenaurach (DE)

( * ) Notice: Subject to any disclaimer, the term of this patent is extended or adjusted under 35 U.S.C. 154(b) by 63 days.

(21) Appl. No.: 15/035,905

(22) PCT Filed: Oct. 8, 2014

(86) PCT No.: PCT/DE2014/200539

§ 371 (c)(1),
(2) Date: May 11, 2016

(87) PCT Pub. No.: WO2015/074652

PCT Pub. Date: May 28, 2015

(65) Prior Publication Data

US 2016/0273420 A1 Sep. 22, 2016

(30) Foreign Application Priority Data

Nov. 22, 2013 (DE) ..... 10 2013 223 926

(51) Int. Cl.
*F01L 9/02* (2006.01)
*F01L 1/16* (2006.01)
*F01L 1/20* (2006.01)

(52) U.S. Cl.
CPC ..... *F01L 9/025* (2013.01); *F01L 1/16* (2013.01); *F01L 1/205* (2013.01); *F01L 9/02* (2013.01); *F01L 9/023* (2013.01)

(58) Field of Classification Search
CPC ..... F01L 9/023
(Continued)

(56) References Cited

U.S. PATENT DOCUMENTS 5,033,420 A * 7/1991 Matayoshi ..... F01L 1/185 123/90.12
5,127,375 A * 7/1992 Bowman ..... F01L 9/023 123/90.12

(Continued)

FOREIGN PATENT DOCUMENTS

DE 4235620 4/1994
DE 19941367 3/2000

(Continued)

*Primary Examiner* — Jorge Leon, Jr.
(74) *Attorney, Agent, or Firm* — Volpe and Koenig, P.C.

(57) ABSTRACT

A hydraulic valve brake for a hydraulic valve drive of an internal combustion engine is provided. The valve brake includes a housing with a housing wall and with a housing base, and includes a piston which moves axially in the housing and one end side of which, together with the housing wall and the housing base, delimits a hydraulic pressure chamber and the other end side of which actuates a gas exchange valve. The housing wall is perforated in the region of the pressure chamber by one or more overflow openings, the opening cross sections of which are controlled by a control edge, which delimits the end side at the pressure chamber side, of the piston. In this case, it is the intention for the axial distance (h) between the control edge of the piston, when the latter is fully retracted into the housing, and the housing base to be set by a spacer of predetermined thickness (d).

5 Claims, 4 Drawing Sheets

(58) Field of Classification Search
USPC ..... 123/90.12
See application file for complete search history.

(56) References Cited

U.S. PATENT DOCUMENTS

| | | | | |
|---|---|---|---|---|
| 6,192,841 | B1 | 2/2001 | Vorih et al. | |
| 6,273,057 | B1 | 8/2001 | Schwoerer et al. | |
| 6,401,676 | B1 | 6/2002 | Tsukui | |
| 6,550,433 | B2 | 4/2003 | Vorih et al. | |
| 6,918,364 | B2 * | 7/2005 | Vattaneo | F01L 9/02 123/90.12 |
| 6,957,634 | B2 | 10/2005 | Chang | |
| 2004/0050350 | A1 * | 3/2004 | Diehl | F01L 9/02 123/90.12 |
| 2005/0034691 | A1 | 2/2005 | Chang | |
| 2009/0217896 | A1 | 9/2009 | Schnell et al. | |
| 2014/0048024 | A1 | 2/2014 | Itoafa et al. | |

FOREIGN PATENT DOCUMENTS

| | | |
|---|---|---|
| DE | 102005053607 | 5/2007 |
| DE | 102009043659 | 3/2011 |
| DE | 102011004403 | 8/2012 |
| EP | 0507521 | 10/1992 |
| WO | 2008115424 | 9/2008 |
| WO | 2010012864 | 2/2010 |

* cited by examiner

HYDRAULIC VALVE DRIVE OF AN INTERNAL COMBUSTION ENGINE

The invention relates to a hydraulic valve brake for a hydraulically actuated, variable valve drive of an internal combustion engine. The hydraulic valve brake comprises a housing with a housing wall and a housing base, a piston that moves axially in the housing and whose one end surface defines, with the housing wall and the housing base, a hydraulic compression chamber and whose other end surface actuates a gas exchange valve, wherein the housing wall is perforated in the area of the compression chamber by one or more overflow openings whose opening cross sections are controlled by a control edge of the piston defining the compression chamber-side end surface.

The invention also relates to an internal combustion engine with a hydraulic valve drive that has such a hydraulic valve brake.

BACKGROUND

One essential component of hydraulically actuated, variable valve drives that operate according to the lost-motion principle and in which a so-called hydraulic linkage with variable reducible hydraulic volume runs between the drive side, usually the cam of a camshaft, and the driven side, i.e., the gas exchange valve, there is a hydraulic valve brake that controls the set-down rate of the closing gas exchange valve independent of the cam position and limits this to specified values that are acceptable acoustically and mechanically. Hydraulic valve drives each with a hydraulic valve brake according to the class are known, for example, from U.S. Pat. No. 6,550,433 B2 and from EP 0 507 521 A1. For such a valve brake, pressure is removed from the compression chamber that becomes smaller with the closing gas exchange valve by one or more overflow openings that extend at the side of the piston in the housing wall and whose opening cross sections are reduced increasingly by a compression-chamber-side control edge of the piston entering into the housing and possibly completely closed.

Because the components of the hydraulic valve brake cannot be produced economically with arbitrarily high precision, there are still component tolerances that produce different braking characteristics even within a single manufacturing batch. However, gas exchange cycle with gas exchange valves that close at the same operating point with different stroke profiles at different crank angles with respect to the piston dead center points negatively affect the power output and emissions behavior of the internal combustion engine.

SUMMARY

The present invention is based on the objective of providing, with simple structural means, prerequisites for improved operational behavior of an internal combustion engine with a hydraulic valve drive and a hydraulic valve brake of the type specified above.

This object is achieved in that the axial distance that the control edge of the piston retracted completely in the housing is set apart from the housing base is adjusted by a spacer of predetermined thickness. By this adjustment, the effects of the component tolerances that significantly influence the braking characteristics of the valve brake are considerably reduced and ideally eliminated. This is because, shortly before the gas exchange valve is closed, its delay profile for constant hydraulic medium viscosity is highly dependent on the profile of the overlap of the opening cross sections controlled by the piston control edge in the housing wall. The axial distance adjusted at a reference point, i.e., for a piston retracted completely in the housing, between the piston control edge and the housing base (or a housing part fixed relative to the housing base) now causes a displacement of the overlap profile corresponding to the predetermined thickness of the spacer to the extent that all hydraulic valve brakes or batches of these valve brakes have the same or a sufficiently similar delay profile.

Valve brakes adjusted according to the invention are suitable not only for valve drives with (automatic) hydraulic valve clearance compensation, but also for valve drives with (manual) mechanical valve clearance compensation, wherein, in the latter case, in particular, large motors with hydraulically actuated, variable valve drives are the focus. For the mechanical valve clearance adjustment, the overlap profile of the piston control edge and opening cross section (s) has only an offset by the (uniformly adjusted) valve clearance. This is because, in this case, the piston and the housing base that is significant for the axial distance are set apart by the valve clearance when the gas exchange valve closes.

The adjustment of the axial distance between the piston control edge and the housing base can be realized in various ways. In particular, an adjustment in discrete thickness steps of the spacer is provided, wherein each thickness is predetermined as a result of a previous test or measurement of the delay profile of the non-adjusted valve brake and the spacer is taken from a group classification accordingly and paired with the valve brake. The spacer can be joined either rigidly to the housing or rigidly to the piston. The spacer has an effect in the displacement-time profile of the piston moving in the valve brake such that the cross sections of the overflow openings are overlapped by the piston control edge only for a larger piston displacement. Here, the valve brake becomes, so to speak, "faster." The term "the spacer" is not necessarily limited to a single part, but can also comprise a group of two or more parts that are then added together as a stack with the predetermined thickness. Due to the multiple combination possibilities, in this case the group classification can be limited to a few individual thicknesses and in the limit case to a single thickness.

In an alternative construction, the spacer can also be constructed as a non-separate, integral part as a projection of the piston on its compression-chamber-side end surface or as a projection of the housing on its housing base. The axial distance can then be adjusted by changing the projection thickness. Relative to the previously mentioned embodiment with joined spacer, a shortening of the projection by the predetermined thickness has the effect that, in the displacement-time profile, the opening cross sections are already covered by the piston control edge for small piston displacements and the valve brake becomes, so to speak, "slower."

BRIEF DESCRIPTION OF THE DRAWINGS

Other features of the invention are given from the following description and from the drawings in which the invention is explained in principle and with reference to an example valve brake. If not mentioned otherwise, features or components that are identical or have identical functions are provided with identical reference symbols. Shown are.

DETAILED DESCRIPTION OF THE PREFERRED EMBODIMENTS

Figure 1:
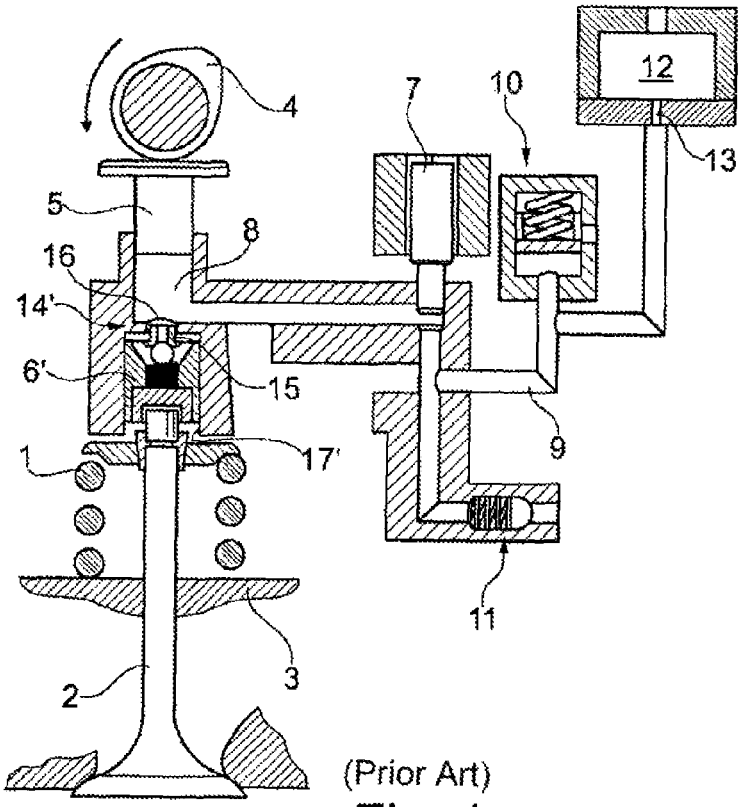
(Prior Art) Fig. 1
FIG. 1 a schematic diagram of a hydraulically actuated, variable valve drive according to the prior art, FIG. 2 a schematic diagram of a hydraulic valve drive with mechanical valve clearance compensation and a valve brake according to the invention, FIGS. 3A-3C the unadjusted valve brake according to FIG. 2 in different piston positions for the basic measurement of the brake characteristics, FIG. 4 a basic diagram for the dimensional predetermination and allocation of a spacer, FIG. 5 the valve brake according to FIGS. 2 and 3 in enlarged illustration, FIG. 6 a simplified diagram for the testing of the adjusted valve brake, FIG. 7 in longitudinal section, the assembled valve brake in structural design, FIG. 8 the housing according to FIG. 7 as individual part in longitudinal section, and FIG. 9 the detail Z according to FIG. 7.

FIG. 1 shows the basic configuration of a known hydraulic valve drive for stroke-variable actuation of a gas exchange valve 2 loaded by a valve spring 1 in the closing direction in the cylinder head 3 of an internal combustion engine. Shown are the following components:

A master piston 5 driven by the cam 4 of a camshaft,

A slave piston 6' actuating the gas exchange valve,

An electromagnetic 2-2-path hydraulic valve 7,

A high-pressure chamber 8 that is defined by the master piston and by the slave piston and from which, when the hydraulic valve is open, hydraulic medium can flow out into a medium-pressure chamber 9, A piston pressure accumulator 10 connected to the medium-pressure chamber, A non-return valve 11 that opens in the direction of the medium-pressure chamber and by which the medium-pressure chamber is connected to the lubricant circuit of the internal combustion engine, And a low-pressure chamber 12 that is used as a hydraulic medium reservoir and is connected to the medium-pressure chamber by a throttle 13 and whose contents are available immediately during the starting process of the internal combustion engine.

The variability of the valve stroke is generated such that the high-pressure chamber 8 between the master piston 5 and the slave piston 6' acts as a so-called hydraulic linkage, wherein the hydraulic volume forced by the master piston—not taking into account any leakage—is split proportional to the stroke of the cam 4 as a function of the opening time and the opening period of the hydraulic valve 7 into a first partial volume loading the slave piston and into a second partial volume flowing out into the medium-pressure chamber 9 including the piston pressure accumulator 10 and into the low-pressure chamber 12. Through the movement of the gas exchange valve 2 decoupled from the movement of the cam, the stroke transfer of the master piston to the slave piston and consequently not only the control times, but also the stroke height of the gas exchange valve within the lift of the cam are completely variably adjustable.

The slave piston 6' is equipped with a hydraulic valve brake 14' that reduces the set-down speed of the closing gas exchange valve 2 decoupled from the movement of the cam 4 to a mechanically and acoustically acceptable level. In the illustrated principle construction, the valve brake is a throttle gap that is formed during the final closing phase of the gas exchange valve by the overlap of a cylindrical projection 15 on the compression-chamber-side end surface of the slave piston with an overflow opening 16 that extends concentric to the housing wall 17' supporting the slave piston.

Figure 2:
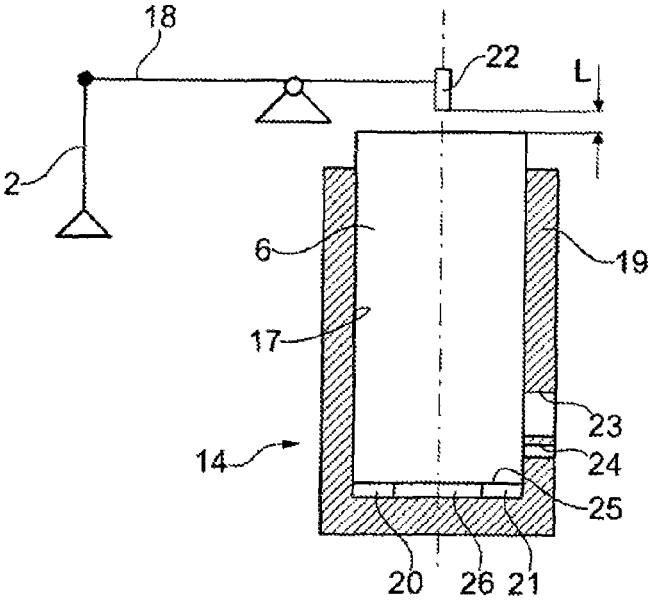

FIG. 2 shows the slave side of a hydraulically actuated, variable valve drive of a large engine whose gas exchange valves 2 are actuated by a rocker arm 18 with mechanical valve clearance compensation. The greatly schematized representation is reduced with respect to the valve drive to the hydraulic valve brake 14 with housing 19 and a slave piston, called piston 6 for short below. The hollow cylindrical housing with a housing wall 17 and a housing base 20 is used for guiding the piston moving axially therein, whose one end surface defines, with the housing wall and the housing base, a hydraulic compression chamber 21. The other end surface of the piston actuates the gas exchange valve 2 by the mechanical valve clearance compensation device in the form of a valve clearance adjustment screw 22 in the rocker arm.

In the housing wall 17 there are overflow openings 23 and 24 by which the compression chamber 21 communicates with the master-side hydraulic system not shown here (see FIG. 1). The overflow opening 23 is used with a relatively large opening cross section as a main flow opening by which, when the piston 6 is moved out and in, the lowest possible throttle volume flow is forced into or out of the compression chamber. The overflow opening 24 forms, with a relatively small opening cross section, a throttle flow opening by which pressure can be relieved from the compression chamber in the final closing phase of the gas exchange valve 2 only under significant delay of the piston moving in. The control of the opening cross sections is realized by a control edge 25 of the piston that is formed in the simplified representation by the circumferential edge between the outer lateral surface of the piston and its compression-chamber-side end surface.

The representation shows the piston 6 in the position moved completely in the housing 19 in which the piston is located during the valve clearance adjustment to the valve clearance L measured between the adjustment screw 22 and the valve-side end surface of the piston. In contrast, during the operating state of the internal combustion engine, the valve clearance is moved for the most part or completely toward the compression-chamber-side end surface. The axial distance between the piston control edge 25 and the housing base 20 is adjusted according to the invention by a spacer 26 that influences the delay profile of the piston moving into the housing so that all of the valve brakes of the internal combustion engine have essentially the same brake characteristics and accordingly all of the gas exchange valves 2 of the internal combustion engine close with approximately the same stroke profile.

Figures 3A, 3B, 3C:
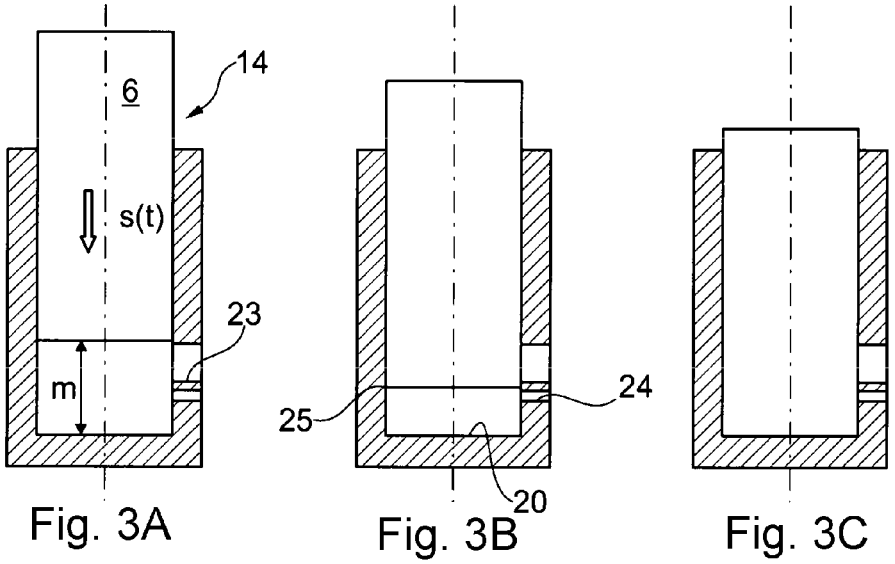

The determination of the spacer thickness d required for the adjusted axial distance h is realized as explained below with reference to the schematic FIGS. 3A-3C to 6. FIGS. 3A-3C show the (still) non-adjusted hydraulic valve brake 14 with three different retraction positions of the piston 6 during the basic measurement of the movement profile s(t). During this measurement performed with oil, the time stroke profile of the piston loaded with a defined force is detected until the housing base 20 is reached. The measurement begins at the stroke s=m and ends at s=0 when the piston is set on the housing base.

Figure 4:
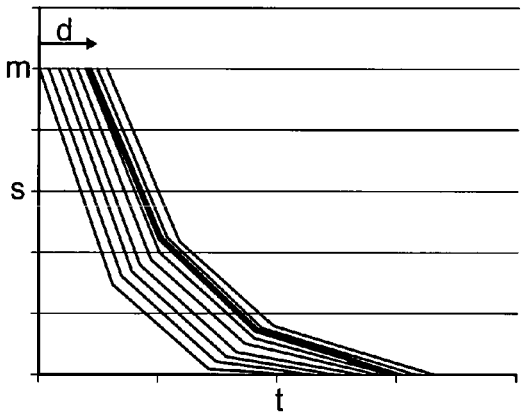

The measurement result is shown greatly simplified in FIG. 4 with reference to the curve with thick line thickness. The upper section of the curve with large gradient, i.e., with comparatively high closing speed of the gas exchange valve 2 corresponds to the piston position in FIG. 3A until pressure can be relieved from the compression chamber 21 still largely non-throttled via the main flow opening 23. The next section of the curve with average gradient, i.e., with comparatively average closing speed, corresponds to the piston position in FIG. 3B, wherein the piston control edge 25 already completely covers the main flow opening and the pressure relief is realized mainly only via the throttle flow opening 24. The lower curve section with small gradient, i.e., with low closing speed, corresponds to the piston position in FIG. 3C, wherein the piston control edge completely covers both the main flow opening and also the throttle flow opening and the pressure relief is realized only via leakage gaps and possibly other throttle flow openings not shown here in the housing base 20.

Figure 5:
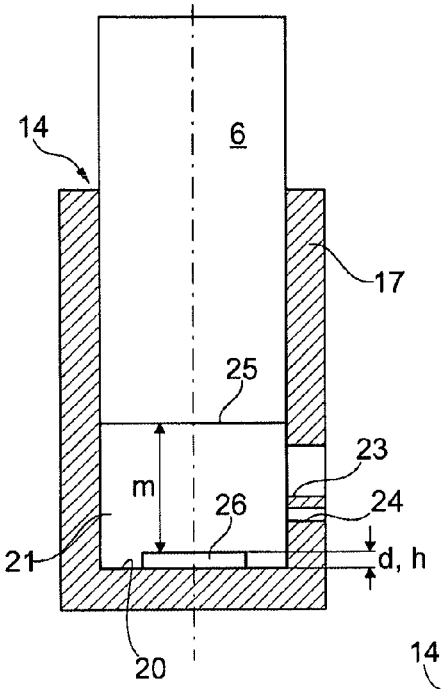
Figure 6:
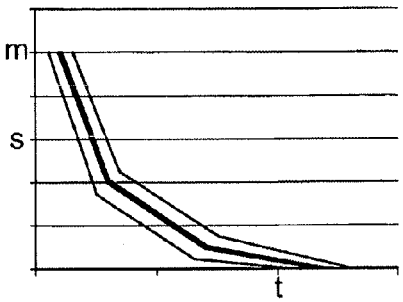

The predetermination of the spacer thickness d, which is identical in the schematic representation according to FIG. 5 with the axial distance h, is now realized by the reference curves drawn with thin line thickness in FIG. 4. These represent different "fast" valve brakes that require more and more time for the measurement path s=m in the figure from left to right and are consequently "slower" in this direction. A spacer 26 with individual thickness d is allocated to each reference curve, wherein the reference curves correspond to increasing thicknesses from left to right. The reference curve with the greatest match with the previously measured movement profile of the valve brake 14 (curve with thick line thickness) determines the individual thickness for this valve brake and thus the selection of a spacer with this thickness to be paired with it from a group assortment. Here, the measurement curve of a relatively "slow" valve brake matches one of the reference curves on the right, so that a spacer with a larger thickness is allocated to this valve brake rather than a relatively "fast" valve brake that matches one of the reference curves on the left and whose movement profile is already closer to the desired adjustment.

FIG. 5 shows the valve brake 14 with the selected and mounted spacer 26 by which the axial distance h between the piston control edge 25 and the housing base 20 is adjusted offset by the predetermined thickness d relative to the non-adjusted valve brake. In a new displacement-time measurement, for an unchanged measurement displacement s=m it can be checked whether according to FIG. 6 the adjustment of the brake characteristics (curve with thick line thickness) is within a desired movement profile as specified by a "slow" limit curve (curve with thin line thickness on the right) and a "fast" limit curve (curve with thin line thickness on the left).

Figure 7:
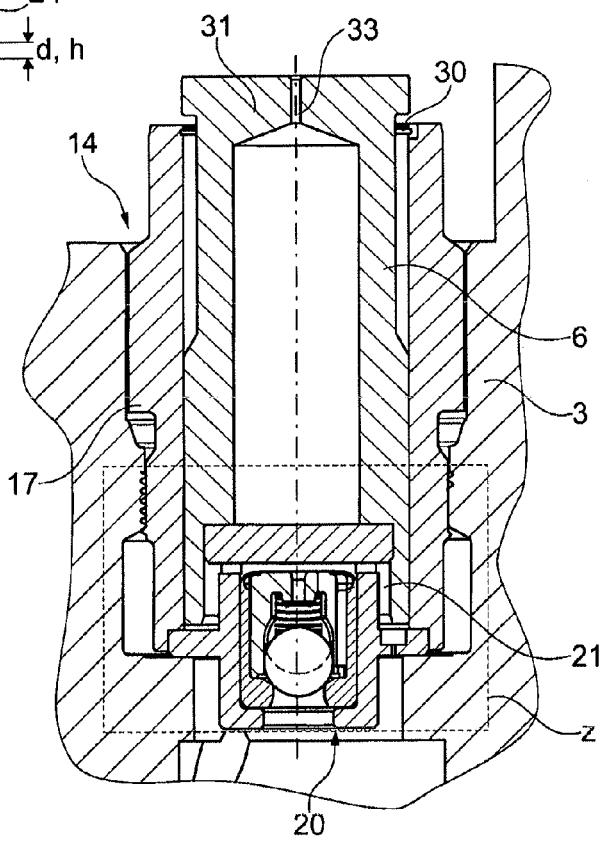
Figure 8:
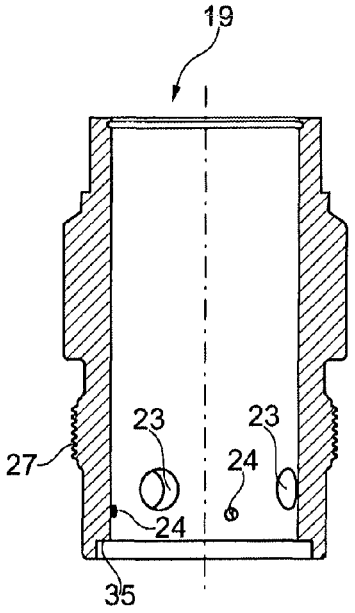
Figure 9:
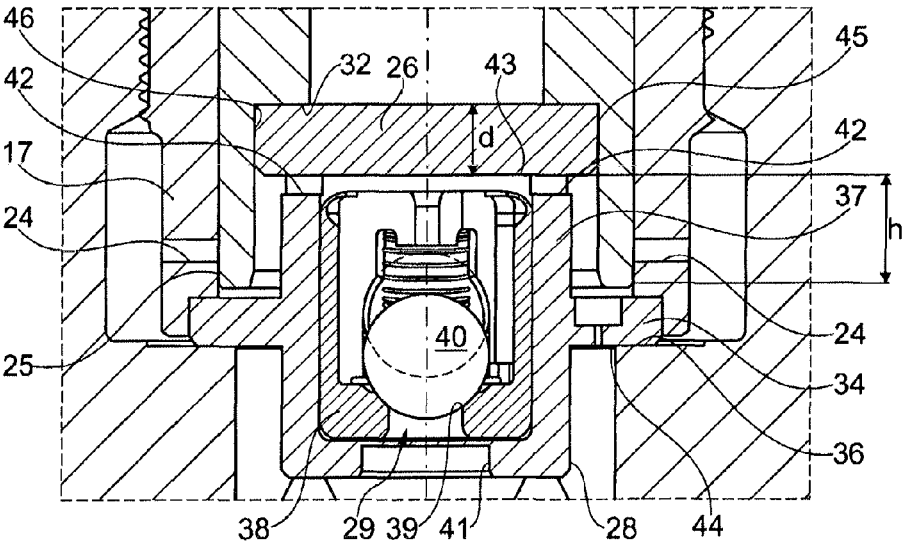

FIGS. 7 to 9 show different views of a constructed example of a hydraulic valve brake 14 according to the invention, which actuates a gas exchange valve 2 of a large engine with mechanical valve clearance adjustment by means of a rocker arm 18 corresponding to FIG. 2. The housing 19 of the valve brake screwed in the cylinder head 3 of the internal combustion engine by an external thread 27 comprises a tubular housing wall 17 and a housing base 20 that is joined with it on the side of the compression chamber 21 and is formed by a valve holder 28 with a non-return valve 29 inserted therein. The piston 6 that moves axially in the housing and is secured against completely coming out of the housing for transport purposes by a snap ring 30 is hollow cylindrical with a piston base 31 forming the gas-exchange-valve-side end surface. The compression-chamber-side end surface of the piston is provided with a recess 32 in the form of a countersunk hole in which an adjustment disk with predetermined thickness d used as a spacer 26 is mounted by a longitudinal interference fit assembly. A hole 33 passing through the piston base is used for ventilation and—in the case of a leakage-prone longitudinal interference fit assembly—as pressure relief of the piston interior.

The housing wall 17 is perforated by four main flow openings 23 and throttle hole openings 24 in the form of drilled holes by means of which the compression chamber 21—as explained above—communicates with the master-side hydraulic system not shown here. The main flow openings run in a first transverse plane and the significantly smaller throttle flow openings run in a second transverse plane that is offset towards the first transverse plane in the retraction direction of the piston 6.

The valve holder 28 comprises an external ring collar 34 that is inserted in a pressurized-medium-tight way in a countersunk hole 35 of the housing wall 17 and is clamped against a shoulder 36 in the cylinder head 3 by the threaded connection 27 and a hollow cylindrical section 37 that projects relative to the ring collar in the direction of the recess 32. The non-return valve 29 comprises a valve carrier 38 similarly inserted in the valve holder 28 in a pressurized-medium-tight way and a valve ball 40 spring-loaded therein against a valve seat 39. This opens in the direction of the compression chamber 21 and controls another overflow opening 41 by means of which the compression chamber likewise communicates with the master-side hydraulic system in order to initialize the extension of the piston 6 for the opening of the gas exchange valve 2. When the adjustment disk 26 is completely on the valve holder, the hydraulic medium overflow into the compression chamber is realized initially via beads 42 on the ring end surface 43 of the hollow cylindrical section.

The opening cross sections of the main and throttle flow openings 23 and 24, respectively, are controlled by the control edge 25 of the piston 6 moving past this edge and are all closed both in the illustrated, completely retracted piston position and also in the piston position extended by the adjusted valve clearance L according to FIG. 2. In order to not delay the final retraction movement of the piston too greatly, the ring collar 34 is perforated by a permanently open, additional throttle flow opening 44 whose hydraulic resistance ultimately defines the set-down speed of the gas exchange valve 2.

Because when the piston 6 is retracted completely in the housing 19 the adjustment disk 26 is on the ring end surface 43, in this case the decisive reference for the adjusted axial distance h between the control edge 25 of the piston 6 retracted completely in the housing 19 and the housing base 20 is not the ring collar 34 but instead the ring edge side that is, like the ring collar, a fixed part of the valve holder 28. Accordingly, the non-adjusted valve brake 14 is provided with a—not shown—dummy adjustment disk of known thickness, so that for the basic measurement explained above (see FIGS. 3*a-c*), the piston is adjusted with the dummy adjustment disk on the ring end surface and not on the ring collar of the valve holder. The dummy adjustment disk to be removed after the basic measurement can be provided, if necessary, with a circumferential O-ring that holds, on one hand, the dummy adjustment disk in the recess 32 in an easily removable way and, on the other hand, seals the compression chamber 21 relative to the ventilation hole 33.

Analogous to FIGS. 3 to 6, the axial distance h is then adjusted by the thickness d of the adjustment disk 26 so that all of the hydraulic valve brakes 14 of the internal combustion engine have essentially the same braking characteristics and accordingly all of the gas exchange valves 2 close essentially equally within a very small range of crank angle. Different than in FIG. 4 with eight reference curves, in the embodiment shown here, adjustment disks 26 are provided with five different thicknesses each in 0.1 mm steps.

In FIGS. 7 and 9, the spacer 26 is pressed on its outer lateral surface 45 in the inner lateral surface 46 of the recess 32 of the piston 6. In order to prevent the risk of an associated, impermissible expansion of the piston 6 guided tightly in the housing wall 17, (not shown) alternative fasteners can be provided. For example, the spacer can be provided with a central hole that is, on one hand, set on a peg-like projection of the solid piston or, on the other hand, through which a pin or a screw is guided that joins the spacer to the piston.

LIST OF REFERENCE NUMBERS

1 Valve spring
2 Gas exchange valve
3 Cylinder head
4 Cam
5 Master piston
6 Slave piston/piston
7 Hydraulic valve
8 High-pressure chamber
9 Medium-pressure chamber
10 Piston pressure accumulator
11 Non-return valve
12 Low-pressure chamber
13 Throttle
14 Hydraulic valve brake
15 Cylindrical projection
16 Overflow opening
17 Housing wall
18 Rocker arm
19 Housing
20 Housing base
21 Compression chamber
22 Valve clearance adjustment screw/mechanical valve clearance adjustment device
23 Overflow opening/main flow opening
24 Overflow opening/throttle flow opening
25 Piston control edge
26 Spacer/adjustment disk
27 External thread/screw connection
28 Valve holder
29 Non-return valve
30 Snap ring
31 Piston base
32 Recess in the piston
33 Ventilation drill hole
34 Ring collar
35 Countersink hole in housing wall
36 Shoulder in cylinder head
37 Hollow cylinder section
38 Valve carrier
39 Valve seat
40 Valve ball
41 Additional overflow opening
42 Bead on valve holder
44 Additional throttle flow opening
45 Outer lateral surface of spacer
46 Inner lateral surface of recess

The invention claimed is:

1. A hydraulic valve brake for a hydraulically actuated, variable valve drive of an internal combustion engine, comprising a housing with a housing wall and a housing base, a piston that moves axially in the housing and having a compression-chamber-side end surface which defines, with the housing wall and the housing base, a hydraulic compression chamber and having an other end surface that actuates a gas exchange valve, the housing wall is perforated in an area of the compression chamber by one or more overflow openings having opening cross sections that are controlled by a control edge of the piston defining the compression-chamber-side end surface, an axial distance (h) that the control edge of the piston completely retracted in the housing is set apart from the housing base is adjusted by a spacer of a predetermined thickness (d), the piston is provided on the compression-chamber-side end surface with a hollow cylindrical recess and the spacer is an adjustment disk that is mounted therein, and the predetermined thickness is a disk thickness (d) used to adjust the axial distance (h).

2. The hydraulic valve brake according to claim 1, wherein the adjustment disk is pressed into the recess of the piston.

3. The hydraulic valve brake according to claim 1, wherein the housing base is formed by a valve holder inserted in the housing wall in a pressurized-medium-tight manner with an additional overflow opening and by a non-return valve that opens to the compression chamber and controls the additional overflow opening.

4. The hydraulic valve brake according to claim 3, wherein the valve holder is inserted with a ring collar in a countersunk hole of the housing wall and has a hollow cylindrical section projecting relative to the ring collar in a direction of a recess in the compression-chamber-side end surface of the piston, and the axial distance (h) of the piston control edge to a ring end surface of the hollow cylindrical section is adjusted.

5. An internal combustion engine comprising a hydraulic valve drive, the valve drive is provided with a hydraulic valve brake according to claim 1 and with a mechanical adjustment device of a valve clearance (L) between the other end surface of the piston and a gas exchange valve.

* * * * *